US007482519B2

(12) United States Patent
Lindén et al.

(10) Patent No.: US 7,482,519 B2
(45) Date of Patent: Jan. 27, 2009

(54) STRINGED MUSICAL INSTRUMENT

(75) Inventors: Jan Anders Lindén, Turku (FI); Erkki Olavi Lindén, Billnäs (FI)

(73) Assignee: Olavi Linden, Billnas (FI)

( * ) Notice: Subject to any disclaimer, the term of this patent is extended or adjusted under 35 U.S.C. 154(b) by 8 days.

(21) Appl. No.: 11/810,948

(22) Filed: Jun. 7, 2007

(65) Prior Publication Data

US 2008/0223192 A1 Sep. 18, 2008

(30) Foreign Application Priority Data

Mar. 15, 2007 (FI) ..... 20075179

(51) Int. Cl.
*G10D 13/02* (2006.01)

(52) U.S. Cl. ..... 84/294; 84/296

(58) Field of Classification Search ..... 84/267, 84/291, 290, 294–296

See application file for complete search history.

(56) References Cited

U.S. PATENT DOCUMENTS

| | | | | |
|---|---|---|---|---|
| 1,741,453 | A | 12/1929 | Dopyera | |
| 1,762,617 | A | 6/1930 | Dopyera | |
| 1,872,633 | A | 8/1932 | Dopyera | |
| 5,567,896 | A * | 10/1996 | Gottschall | 84/294 |
| 5,678,074 | A * | 10/1997 | Mori et al. | 396/131 |

* cited by examiner

*Primary Examiner*—Kimberly R Lockett
(74) *Attorney, Agent, or Firm*—Ladas and Parry LLP

(57) ABSTRACT

The present invention relates to a stringed musical instrument comprising a hollow body with a top having a first opening or openings, a bottom and sides, one or more strings held in tension over said body, a bridge supporting the strings and positioned on the top adjacent the first opening or openings, a diaphragm resonator provided inside the hollow body and connected to the top below and surrounding the first opening or openings, and at least one second opening. According to the invention the bridge is suspended to the body and connected to the diaphragm resonator such that the vibration of the strings passes through the bridge to the diaphragm resonator.

30 Claims, 4 Drawing Sheets

STRINGED MUSICAL INSTRUMENT

CROSS-REFERENCE TO RELATED PATENT APPLICATIONS

Finland Priority Application 20075179, filed Mar. 15, 2007, including the specification, drawings, claims and abstract, is incorporated herein by reference in its entirety.

FIELD OF THE INVENTION

The present invention relates to a stringed musical instrument, and particularly to a stringed musical instrument comprising a hollow body with a top having a first opening or openings therein, a bottom and sides, one or more strings held in tension over the said body, a bridge supporting the strings and positioned on the top adjacent the first opening or openings, and at least one second opening operating provided on the top and operating as a sound opening.

BACKGROUND OF THE INVENTION

There are numerous designs for acoustical stringed instruments that may be plucked or bowed. Conventionally these instruments comprise a hollow body having one or more openings serving as sound holes. The strings are tensioned over the hollow body such that the hollow body forms a sounding board for vibrations of the strings when plucked or bowed. In many cases the sound intensity produced by an acoustical stringed instrument is not enough when the instrument is used in a large spaces. Therefore, there are acoustical instruments provided with resonators or diaphragms to intensify the sound produced by the instrument when plucked or bowed. These kinds of instruments are described in, for example, U.S. Pat. Nos. 1,762,617; 1,741,453; and 1,872,633. In the instruments described in the mentioned patents above, the vibration of the strings is transferred to the diaphragm that enhances the sound by vibrating.

One of the disadvantages associated with the above arrangements is that the diaphragms have to support the downward pressure of the strings on a bridge provided on the top of the hollow body of the instrument. Therefore, the diaphragms have to be made considerably rigid, and of materials which do not creep under load. The movability of such diaphragms is limited and therefore the radiation of sound is also limited. This limitation is accentuated at low frequencies, which needs large movement of the diaphragm. The need of a large displacement of air is also underlined by the relative insensitivity of the human ear at low frequencies. Furthermore, in the old designs with resonators the rear side of the diaphragm is in contact with the inner cavity of the instrument body. The sound is then radiated through openings in the body. The cavity of undefined hollow shape cannot enhance or amplify the sound, instead it dampens it.

SUMMARY OF THE INVENTION

The present invention relates to a stringed musical instrument that includes a hollow body with a top having a first opening or openings, a bottom and sides, one or more strings held in tension over the body, a bridge supporting the strings and positioned on the top adjacent the first opening or openings, and at least one second opening provided on the top and operating as a sound opening. The stringed musical instrument also includes a substantially conical tube having a large end and a smaller end, the conical tube being arranged inside the hollow body such that at least the one second opening forms an opening or openings to the substantially conical tube at or in the vicinity of the larger end, and that the first opening or openings are in communication with air column in the conical tube between larger and the smaller end of the conical tube.

The present invention also relates to a stringed musical instrument that includes a hollow body with a top having a first opening or openings, a bottom and sides, one or more strings held in tension over the body, a bridge supporting the strings and position on the top adjacent the first opening or openings, a diaphragm resonator provided inside the hollow body and connected to the top below and surrounding the first opening or openings and at least one second opening provided on the top and operating as a sound opening. The bridge of the stringed musical instrument is suspended to the body with a spring element and connected to the diaphragm resonator such that the vibration of the strings passes through the bridge to the diaphragm resonator.

The present invention also relates to a stringed musical instrument that includes a hollow body with a top having a first opening or openings, a bottom and sides, one or more strings held in tension over said body, bridge supporting the strings and positioned on the top adjacent the first opening or openings, a diaphragm resonator provided inside the hollow body and connected to the top below and surrounding the first opening or openings, and at least one second opening operating as a sound opening. The bridge of the stringed musical instrument is suspended to the body with a spring element and connected to the diaphragm resonator such that the vibration of the strings passes through the bridge to the diaphragm resonator. The stringed musical instrument also includes a substantially conical tube having a larger end and a smaller end and arranged inside the hollow body such that at least one second opening is provided at or in the vicinity of the larger end of the conical tube, and that the first opening or openings is in vibration communication with air column in the conical tube between the larger end and smaller end of the conical tube.

DETAILED DESCRIPTION OF THE INVENTION

Figure 2:
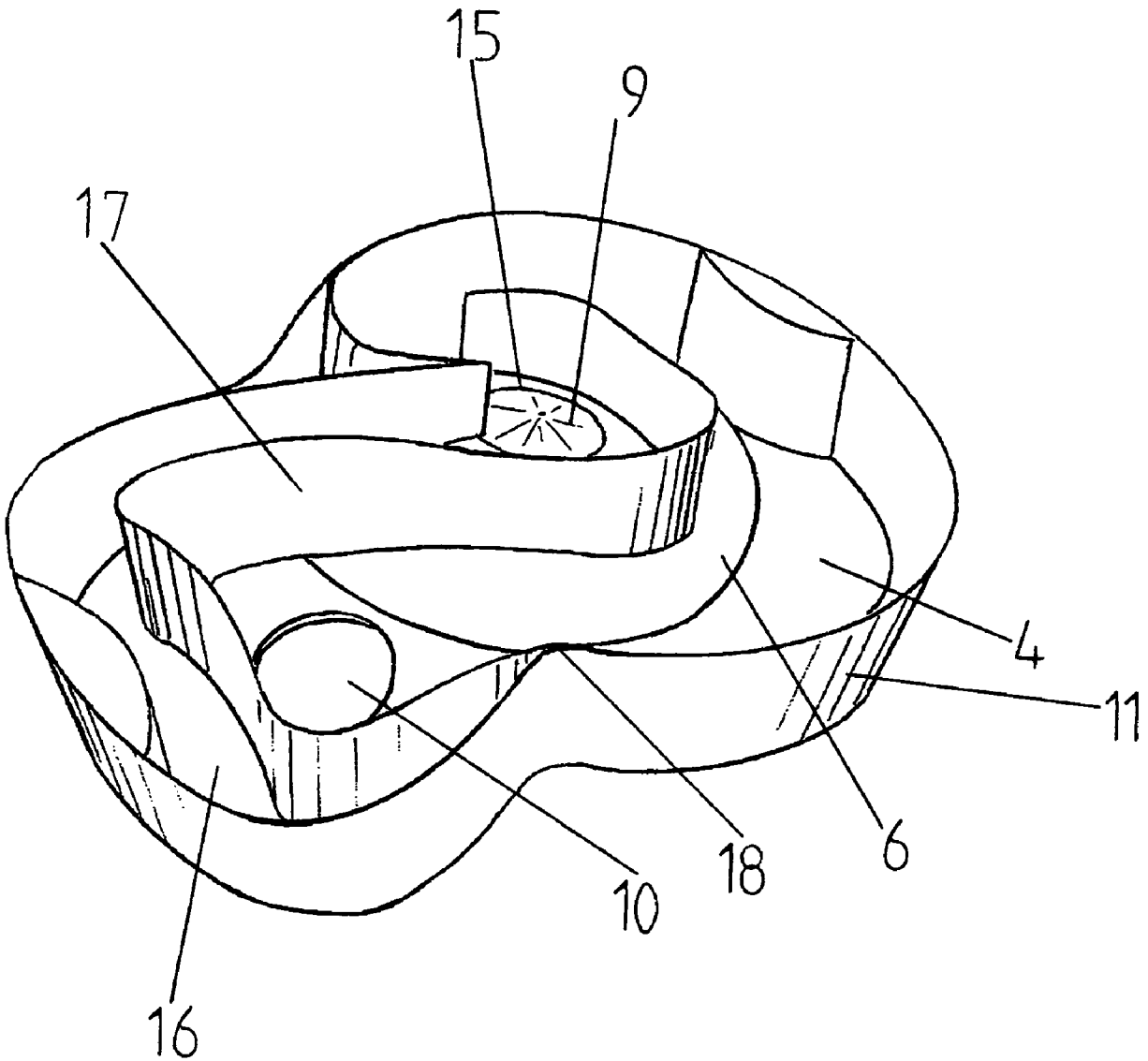
FIG. 2 shows a perspective view of the construction of the hollow body according to one embodiment of the present invention.

FIG. 2 shows one embodiment of a stringed musical instrument. The musical instrument comprises a hollow body having a top 4, bottom (not shown) and sides 11 providing together a cavity inside the body. The instrument is provided with strings 1 tensioned over the top 4 of the hollow body.

Figure 1:
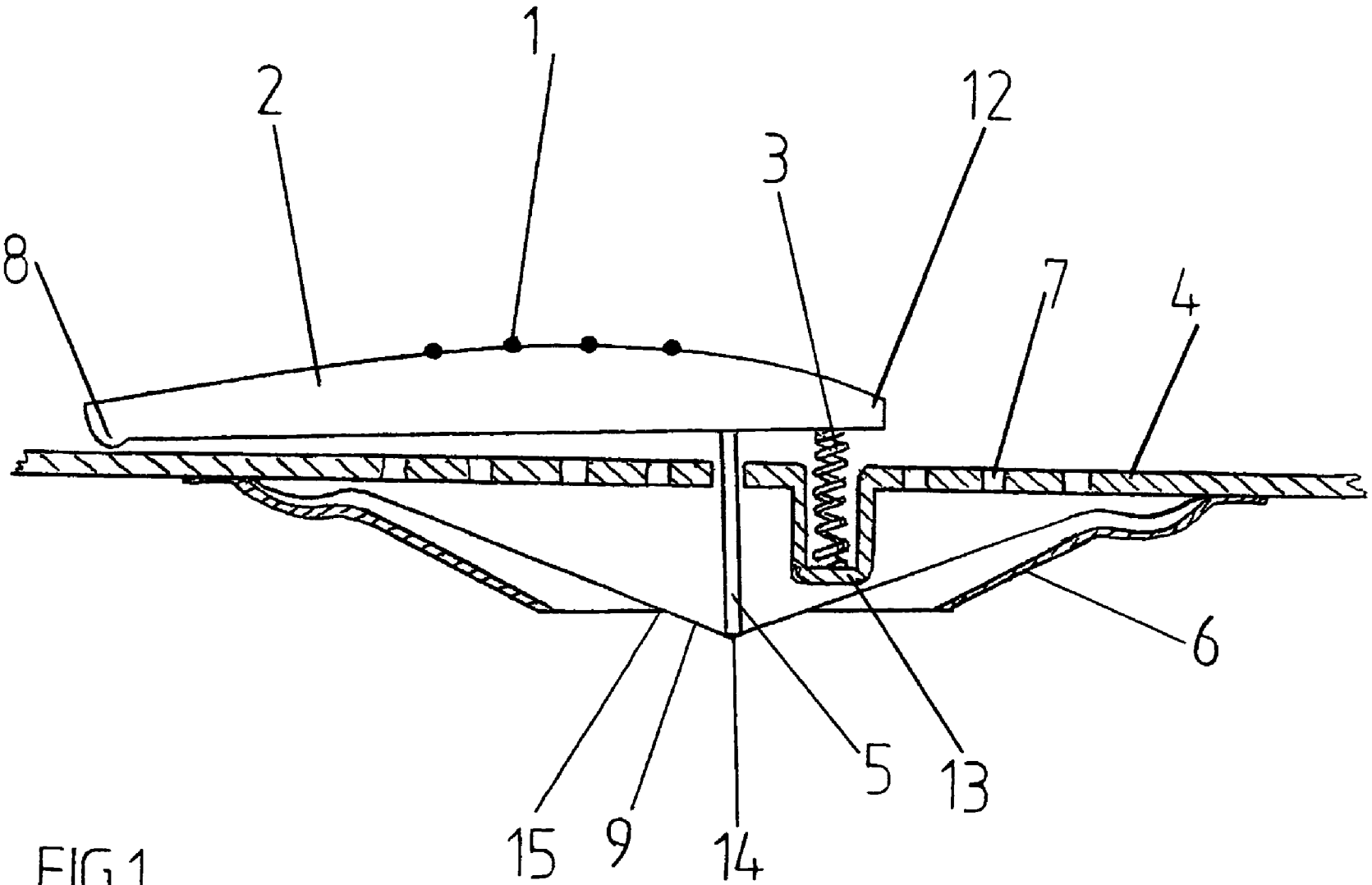
FIG. 1 shows a diaphragm arrangement according to one embodiment of the present invention.

The strings are supported by a bridge 2 provided on the top 4 of the hollow body and between the top 4 and the strings 1, as shown in FIG. 1. The instrument may further comprise a longitudinal neck and tail piece (not shown) with the strings 1 tensioned between the distal end of the neck and the tail piece. The hollow body further comprises at least one first opening 7 provided on the top 4 and adjacent of which the bridge 2 is positioned, as shown in FIG. 1. The opening or openings 7 may be of any shape and may consist of any number of individual openings. In the embodiment shown in FIG. 1 the first opening 7 comprises several longitudinal openings forming a lattice structure. In the mentioned lattice structure the first openings 7 extend parallel with the strings 1, but they may also extend in another direction. The top 4 of the hollow body further comprises at least one second opening 10 serving as a sound hole, shown in FIG. 2.

FIG. 1 shows one embodiment of a resonator arrangement according to the present invention. The bridge 2 is suspended to the hollow body and preferably to the top 4 such that the vibration of the strings 1 forces the bridge 2 to vibrate. One solution for the suspension of the bridge 2 is to use a spring element 3 arranged between the top 4 and the bridge 2. Accordingly, in FIG. 2 the bridge 2 extends transversely to the strings 1 and has a first end 8 engaged or hinged to the top 4 and a second end 12 capable of moving relative to the body or the top 4. The bridge 2 is further provided with the spring element 3 that is located to the second end 12 or between the second end 12 and the first end 8, preferably closer to the second end 12. The engagement between the first end of the bridge 2 is accomplished such that bridge can pivot around the first end 8. A hinge or other attachment means may be used to engage the first end 8 of the bridge to the top.

The spring element 3 may be a coil spring, elliptical bogie spring or the like spring element. The spring element 3 has a certain coefficient that it can receive the downward pressure produced by the strings 1 against the bridge 2 such that the second end 12 of the bridge remains spaced apart from the top 4. In other words the spring element 3 is arranged to receive the pressure of the strings 1 such that it is capable to move, reciprocate and/or vibrate relative to the body when the strings 1 are plucked or bowed. In FIG. 1 the top 4 has a blind hole 13 into which the spring element 3 is received. Thus the spring element 3 extends between the top 4 and the bridge 2 and may be attached to both or only to the bridge 2, if necessary. Alternatively, the top 4 may be flat such that the spring element 3 extends between the flat top 4 and the bridge 2. As shown on FIG. 1, the musical instrument further comprises a diaphragm resonator 9 provided underneath of the top 4 inside the hollow body and connected to the top 4 below and surrounding the first opening or openings 7. This diaphragm 9 may be made of any suitable material, such as carbon fiber laminate, paper, plastic or the like. The diaphragm 9 is attached to the underside of the top 4 inside the hollow body. Furthermore, the diaphragm 9 may be attached to the top 4 around the first openings 7 such that the attachment line of the diaphragm surrounds the first openings 7 circumferentially. Glue, resin, varnish or the like substance or mechanical attachment means may be used for attaching the diaphragm 9 to the top 4. The shape of the diaphragm 9 is preferably circular, but other shapes may also be used, such as elliptical, square, rectangular, triangular, disc-like or any other polygonal shape.

As shown in FIG. 1, the diaphragm 9 has a conical shape that tapers away from the top 4 and opens towards the top 4. In other words the diaphragm 9 has a dish like shape opening towards the top 4 having a center 14 that forms the tip of the diaphragm 9. The bridge 2 is connected to the diaphragm 9 with a pin 5 extending from the bridge 2 to the diaphragm 9. The pin 5 is preferably attached to the bridge 2 and makes contact with the diaphragm 9. Advantageously, the pin 5 is located to the bridge 2 such that it makes contact with the diaphragm 9 at the center 14 of the diaphragm 9. The length of the pin 5 is such that when strings 1 are not plucked or bowed they are in a rest state. Pin 5 makes light contact with the diaphragm 9, but the spring element 3 receives most or essentially all of the downward pressure against the bridge produced by the strings 1.

According to the structure shown in FIG. 1, the vibrations of the strings 1 when plucked or bowed transfers to the suspended bridge 2 that also vibrates against the spring element 3 transferring the vibrations through the pin 5 to the diaphragm 9. The diaphragm 9 then vibrates according to the plucked or bowed strings 1 intensifying the sound. The suspended bridge 2 produces substantial movement when the strings 1 are plucked or bowed. This movement transfers from the bridge 2 through the pin 5 to the diaphragm reproducing the substantially large movement. The large movement is able to move a large amount of air helping therefore to intensify the sounds and especially the low frequencies of the sounds.

It should be noted that the pin 5 may also be passed through the spring element 3, particularly when a coil spring is used. This means that bridge 2 is connected to the diaphragm resonator 9 directly with a pin extending from the bridge 2 to the diaphragm resonator 9, and that the spring element 3 is a coil spring through which the pin 5 extends. Additionally, the pin 5 may be replaced by a different kind of part that is in contact with the diaphragm 9. The pin 5 may be replaced with any structure making contact between the bridge 2 and the diaphragm 9.

The resonator assembly shown in FIG. 1 also includes a sound guide plate 6 that guides the sound waves produced by resonator 9 into the hollow body of the instrument. Sound guide 6 is a plate that substantially imitates the shape of the diaphragm 9 and it is provided inside the hollow body and underneath the diaphragm 9 viewed from the top 4, as shown in FIG. 1. The sound guide 6 is attached to the top 4 similarly with the diaphragm 9 such that it surrounds the first opening or openings 7 circumferentially on the underside of the top 4. The sound guide 6 has a shape of a truncated cone with a sound wave opening 15 at the truncated end. The sound wave opening is preferably provided such that it is adjacent the center 14 of the diaphragm 9. As shown in FIG. 1 the sound wave opening 15 may also be arranged to receive the center 14 of the diaphragm 9. The diameter or area of the sound wave opening 15 may be chosen according to the size of the diaphragm 9 and the size of the instrument and also according to the wavelengths to be produced with the instrument. The sound guide 6 may be made from wood, plastic, fibrous material or any kind of material suitable for guiding sound waves.

When the strings 1 are plucked or bowed the vibrations of the strings 1 are transferred to the diaphragm 9 through the bridge 2 and the pin 5. The upper side of the diaphragm 9 radiates the sound through the first openings 7 directly to the room, but the rear side of the diaphragm 9 is in contact with the air inside the hollow body of the instrument. The hollow body may serve as a sound board and the sound radiates out of the hollow body through the one or more second openings 10 (shown in FIGS. 2 and 3). Therefore the resonator assembly of the present invention may intensify the sound produced by the instrument as the diaphragm may be substantially moved.

In many cases there still exists some limitations regarding the low frequencies produced with the stringed musical instrument. This is particularly considerable in bass guitars, bass fiddles and other instruments producing low frequency sounds when plucked or bowed. Therefore the musical instrument may be provided with a substantially conical tube 16 inside the hollow body of the instrument, as shown FIG. 2. The substantially conical tube 16 may be folded inside the hollow body such that it is twisty. The conical or tapering tube 16 is folded into the shape of a guitar, fiddle or some other instrument it is used in, and the opening for the low frequencies is located at the place of the round sound hole, typical for a guitar or a like instrument.

In the embodiment of FIG. 2, the substantially conical tube 16 is provided by arranging a wall 17 inside the hollow body. The wall 17 extends from the top 4 to the bottom (not shown) and has a first end 18 connected to a side 11 of the hollow body and a second end 19 spaced apart from the sides 11 of the hollow body such that the wall 17 and the sides 11 of the hollow body are arranged to form the substantially conical 16 tube together with the top 4 and the bottom. FIG. 2 shows one embodiment of the wall 17 and the conical tube 16. However, the conical tube 16 and the wall may be arranged in any suitable way for producing a substantially conical tube 16. The wall 17 may be made of wood, plastic or some other suitable material. It is possible to provide the conical tube 16 such that the at least one of the sides 11 and/or the top 4 and/or the bottom of the hollow body is arranged to form at least part of the substantially conical tube 16. Alternatively, the conical tube 16 may be a separate tube or pipe mounted inside the hollow body. The cross-section of the substantially conical tube may be a round, square, rectangular or other polygonal cross section.

The conical tube 16 has a larger end and a smaller end. The smaller end 30 is shown in FIG. 2 at the end 18 of the wall 17. The at least one second sound opening 10 is arranged at the larger end of the substantially conical tube 16 or in the vicinity of or adjacent to the larger end of the substantially conical tube 16 (or the substantially conical tube is arranged such that the at least one second opening 10 is at the larger end or in the vicinity of or adjacent to the larger end of the substantially conical tube 16). The larger end of the substantially conical tube 16 may also be referred to as the base of the tube. Furthermore, the top 4 and the substantially conical tube 16 are provided with at least one first opening 7 that is arranged to be located between the smaller and larger end 18, 19 of the substantially conical tube 16. These first openings 7 (FIG. 1) are located near or adjacent the bridge 2 (FIG. 1) of the instrument such that the sound waves produced by the strings when plucked or bowed may enter or transfer into the substantially conical tube 16. Thus, the first opening or openings 7 are in communication with the air column in the substantially conical tube 16 between the larger and the smaller end of the conical tube. The first openings 7 are preferably arranged substantially in the middle of the length of the conical tube 16. Furthermore, the at least one second opening 10 has a significantly smaller area than the larger end of the conical tube. In other words the at least one second opening 10 is smaller than the base of the substantially conical tube 16.

Figure 3:
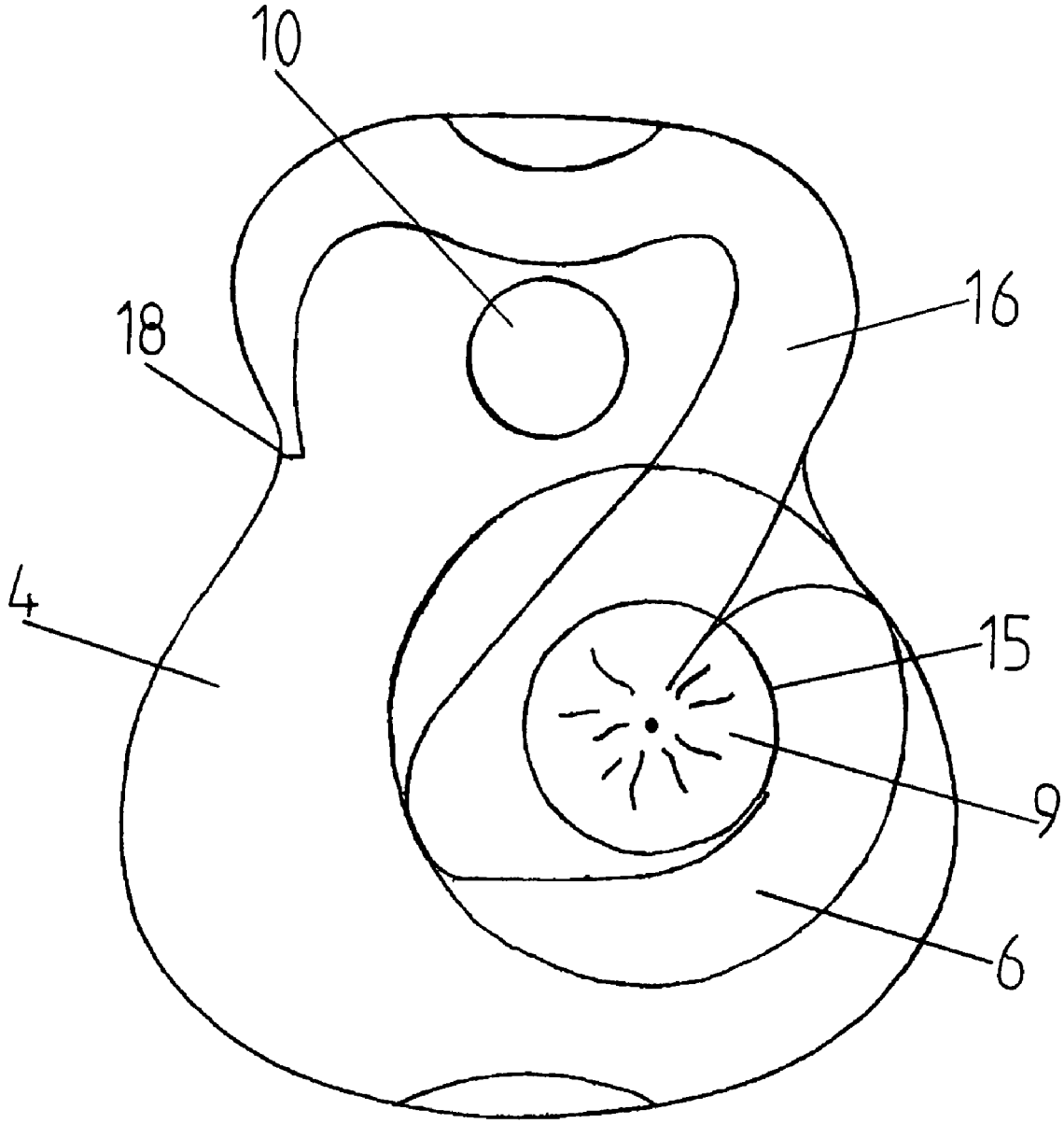
FIG. 3 shows a top view of the construction of the hollow body according to one embodiment of the present invention.
Figure 4:
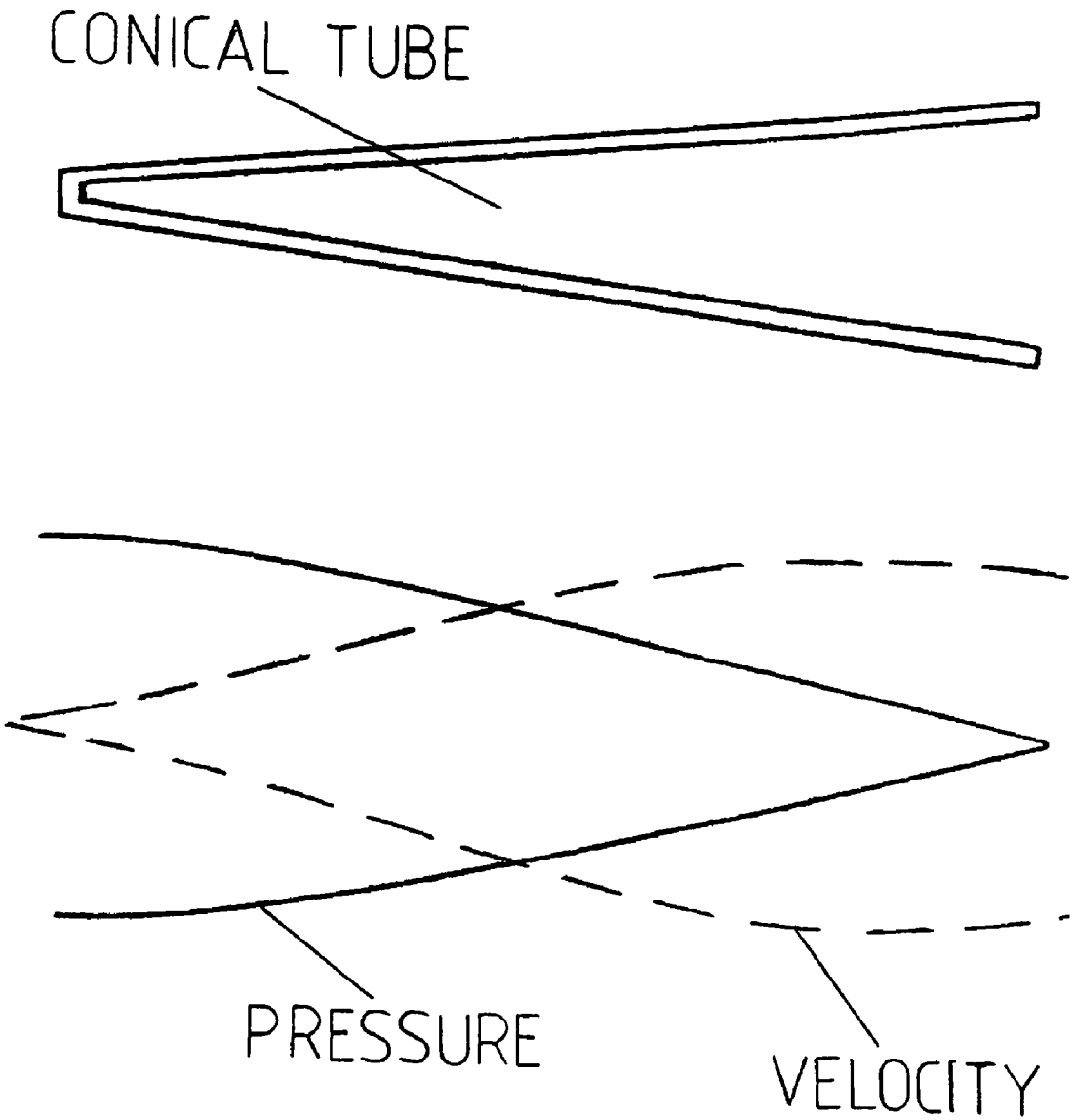
FIG. 4 shows the relationship of sound pressure and velocity in a conical tube.

The substantially conical tube acts as an oscillator for the low frequencies, thus reinforcing them. FIG. 4 shows the relationship of the pressure and velocity of air in a conical tube. As can be seen from this FIG. 4, the velocity of air is increased at the larger end of the conical tube. Sound waves are radiated to the room through the second opening 10 at the larger end 19 of the tube 16. The length of the conical tube 16 is optimal when it is one quarter of the longest wavelength of sound the instrument is designed to produce. For example, the lowest note, E (41 Hz), for a bass guitar has a wavelength of about 8 meters. A quarter of 8 meters is 2 meters. A tapered tube of two meters length can be folded into a guitar body, as shown in FIG. 3. Therefore, a substantially conical tube 16 arranged in the mentioned manner inside the hollow body of a stringed instrument may reinforce or intensify the sounds, and especially low frequencies of the musical instrument.

In the case of FIGS. 2 and 3, showing the same structure produced into a bass guitar, the above described resonator assembly is combined with a substantially conical tube 16. In this embodiment, diaphragm 9 and the resonator assembly are provided at the middle of the length of the substantially conical tube 16 at the place of the first opening 7 such that the sound wave opening 15 of the sound guide opens into the conical tube 16. Then the diaphragm 9 is in contact with the air column in the conical tube 16 between the smaller and the larger ends 18, 19 of the conical tube 16, and preferably in the middle of the length of the tube 16, as is shown in FIG. 2 and FIG. 3. In this structure the resonator assembly first reinforces the sound waves produced by the strings 1 when plucked or bowed in a manner described earlier. And the diaphragm 9 further radiates the sound into the conical tube 16 from which the sound propagates through the at least one second opening 10. This way the sound of the instrument, and especially the low frequencies, may be reinforced considerably. It should also be noted that the conical tube may also be used with other kinds of resonator assemblies or even alone without any resonator.

An instrument built as described above is louder than any hitherto built acoustic instrument. The reproduction of low notes is especially efficient. The new design is applicable to all kind of plucked instruments and also bowed instruments, particularly bass instruments.

It will be obvious to a person skilled in the art that, as the technology advances, the inventive concept can be implemented in various ways. The invention and its embodiments are not limited to the examples described above but may vary within the scope of the claims.

What is claimed is:

1. A stringed musical instrument comprising a hollow body with a top having a first opening or openings therein, a bottom and sides, one or more strings held in tension over the said body, a bridge supporting the strings and positioned on the top adjacent the first opening or openings, and at least one second opening provided on the top and operating as a sound opening, wherein the instrument further comprises a substantially conical tube having a larger end and a smaller end, the conical tube being arranged inside the hollow body such that the at least one second opening forms an opening or openings to the substantially conical tube at or in the vicinity of the larger end, and that the first opening or openings are in communication with air column in the conical tube between the larger and the smaller end of the conical tube.

2. A stringed musical instrument according to claim 1, wherein it comprises a wall extending from the top to the bottom and having a first end connected to a side of the hollow body and a second end spaced apart from the sides of the hollow body such that the wall and the sides of the hollow body are arranged to form the substantially conical tube together with the top and the bottom.

3. A stringed musical instrument according to claim 1, wherein the at least one of the sides and/or the top and/or the bottom of the hollow body is arranged to form at least part of the substantially conical tube.

4. A stringed musical instrument according to claim 1, wherein the substantially conical tube is a separate tube mounted inside the hollow body.

5. A stringed musical instrument according to claim 1, wherein the substantially conical tube has a round, square, rectangular or other polygonal cross section.

6. A stringed musical instrument according to claim 1, wherein the at least one second opening has a significantly smaller area than the larger end of the conical tube.

7. A stringed musical instrument according to claim 1, wherein the one or more first openings are arranged substantially in the middle of the length of the conical tube.

8. A stringed musical instrument according to claim 1, wherein the length of the conical tube is a quarter of the wavelength of lowest note the stringed musical instrument is designed to produce.

9. A stringed musical instrument according to claim 8, wherein the length of the conical tube is approximately 2 meters for a bass guitar.

10. A stringed musical instrument comprising a hollow body with a top having a first opening or openings therein, a bottom and sides, one or more strings held in tension over the said body, a bridge supporting the strings and positioned on the top adjacent the first opening or openings, a diaphragm resonator provided inside the hollow body and connected to the top below and surrounding the first opening or openings and at least one second opening provided on the top and operating as a sound opening wherein the bridge is suspended to the body with a spring element and connected to the diaphragm resonator such that the vibration of the strings passes through the bridge to the diaphragm resonator.

11. A stringed musical instrument according to claim 10, wherein the bridge has a first end engaged to the body and a second end suspended with the spring element to the body.

12. A stringed musical instrument according to claim 10, wherein the bridge is connected to the diaphragm resonator directly with a pin extending from the bridge to the diaphragm resonator.

13. A stringed musical instrument according to claim 12, wherein the pin is connected to the bridge such that the pin is in contact with the center of the diaphragm resonator.

14. A stringed musical instrument according to claim 12, wherein the pin is arranged to extend from the bridge to the diaphragm resonator through the one or more first openings.

15. A stringed musical instrument according to claim 10, wherein the diaphragm resonator has a generally conical shape tapering away from the top.

16. A stringed musical instrument according to claim 10, wherein the spring element is a coil spring, elliptical bogie spring or the like spring element.

17. A stringed musical instrument according to claim 10, wherein the bridge is connected to the diaphragm resonator directly with a pin extending from the bridge to the diaphragm resonator, and that the spring element is a coil spring through which the pin extends.

18. A stringed musical instrument according to claim 10, wherein the first opening or openings are formed as a lattice comprising two or more elongated openings.

19. A stringed musical instrument according to claim 10, wherein the instrument further comprises a sound guide plate provided inside the hollow body and underneath the diaphragm resonator and connected to the top below and surrounding the first opening or openings.

20. A stringed musical instrument according to claim 19, wherein the sound guide plate has a shape of a truncated cone with a sound wave opening at the truncated end, the sound wave opening being arranged to receive the center of the diaphragm resonator.

21. A stringed musical instrument comprising a hollow body with a top having a first opening or openings therein, a bottom and sides, one or more strings held in tension over said body, bridge supporting the strings and positioned on the top adjacent the first opening or openings, a diaphragm resonator provided inside the hollow body and connected to the top below and surrounding the first opening or openings, and at least one second opening operating as sound opening, wherein the bridge is suspended to the body with a spring element and connected to the diaphragm resonator such that the vibration of the strings passes through the bridge to the diaphragm resonator, and that the instrument further comprises a substantially conical tube having a larger end and a smaller end and arranged inside the hollow body such that the at least one second opening is provided at or in the vicinity of the larger end of the conical tube, and that the first opening or openings is in vibration communication with air column in the conical tube between the larger and smaller end of the conical tube.

22. A stringed musical instrument according to claim 21, wherein it comprises a wall extending from the top to the bottom and having a first end connected to a side of the hollow body and a second end spaced apart from the sides of the hollow body such that the wall and the sides of the hollow body are arranged to form the substantially conical tube together with the top and the bottom.

23. A stringed musical instrument according to claim 21, wherein the at least one second opening has a significantly smaller area than the larger end of the conical tube.

24. A stringed musical instrument according to claim 21, wherein the one or more first openings are arranged substantially in the middle of the length of the conical tube.

25. A stringed musical instrument according to claim 21, wherein the length of the conical tube is a quarter of the wavelength of lowest note the stringed musical instrument is designed to produce.

26. A stringed musical instrument according to claim 25, wherein the length of the conical tube is approximately 2 meters for a bass guitar.

27. A stringed musical instrument according to claim 21, wherein the bridge has a first end engaged to the body and a second end suspended with the spring element to the body.

28. A stringed musical instrument according to claim 21, wherein the bridge is connected to the diaphragm resonator directly with a pin extending from the bridge to the diaphragm resonator.

29. A stringed musical instrument according to claim 21, wherein the spring element is a coil spring, elliptical bogie spring or the like spring element.

30. A stringed musical instrument according to claim 21, wherein the instrument further comprises a sound guide plate provided inside the hollow body and underneath the diaphragm resonator and connected to the top below and surrounding the first opening or openings.

* * * * *